United States Patent [19]

Doppelt

[11] 3,988,856

[45] Nov. 2, 1976

[54] TOY MUSICAL CRADLE

[75] Inventor: Lawrence Doppelt, Great Neck, N.Y.

[73] Assignee: Goldberger Doll Mfg. Co., Inc., Brooklyn, N.Y.

[22] Filed: Oct. 14, 1975

[21] Appl. No.: 622,106

[52] U.S. Cl. ..... 46/175 R; 46/191

[51] Int. Cl.[2] ..... A63H 5/00

[58] Field of Search ..... 46/117, 155, 175, 191

[56] References Cited

UNITED STATES PATENTS

| | | | |
|---|---|---|---|
| 901,762 | 10/1908 | Wetzel | 46/155 |
| 2,751,710 | 6/1956 | Pace | 46/175 R |
| 2,757,480 | 4/1956 | Uchill | 46/117 |
| 2,770,159 | 11/1956 | Kato | 46/175 R |

*Primary Examiner*—Louis G. Mancene
*Assistant Examiner*—Robert F. Cutting
*Attorney, Agent, or Firm*—Kirschstein, Kirschstein, Ottinger & Frank

[57] ABSTRACT

A toy rocking cradle with integral musical instrument. The musical instrument is mounted on a headboard of the cradle and is characterized by having at least one freely suspended movable member and at least one fixed member, so that when the cradle is rocked the musical instrument emits a musical sound.

2 Claims, 4 Drawing Figures

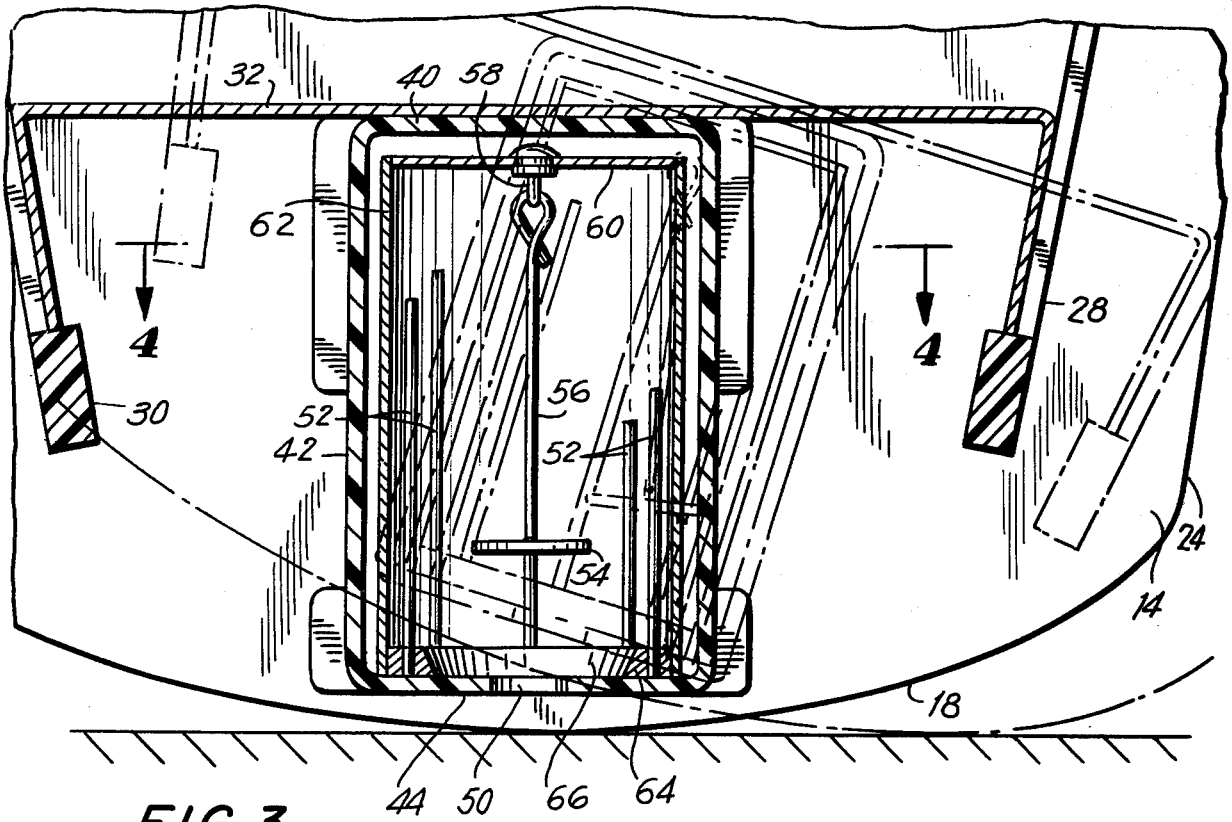
FIG. 3
FIG. 4
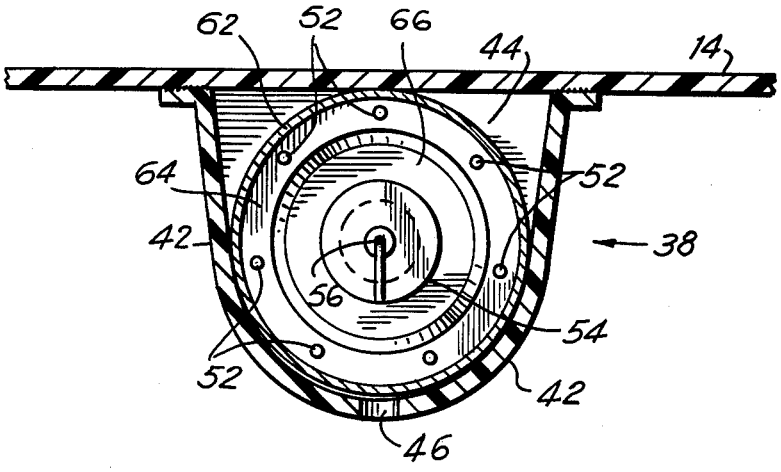

TOY MUSICAL CRADLE

BACKGROUND OF THE INVENTION

1. Field of the Invention

The invention relates to a toy cradle to be used as a plaything for small children.

2. Description of the Prior Art

Toy rocking cradles for the amusement of children have been known for many years. Many devices known to the musical arts such as chimes, or musical tone bars, a bell, and a xylophone, or the like, are characterized by the provision of at least one movable member and at least one fixed member. Contact between the movable member and the fixed member causes the instrument to emit a musical sound. In the case of a bell or chimes or the like, the movable member is a freely suspended pendulum striker.

SUMMARY OF THE INVENTION

1. Purposes of the Invention

It is an object of the present invention to provide an improved toy rocking cradle.

Another object is to provide a toy rocking cradle with integral musical instrument.

A further object is to provide a toy rocking cradle which emits a musical sound when rocked by a child.

An additional object is to provide an improved toy for the amusement of a child.

Still another object is to provide a musical toy rocking cradle in which the source of the musical sound is hidden from the view of a child.

These and other objects and advantages of the present invention will become evident from the description which follows.

2. Brief Description of the Invention

In the present invention, a toy rocking cradle is disclosed which provides an added attraction for the amusement of children, namely the provision of an integral musical instrument together with the cradle. The musical instrument is characterized by the emission of a harmonious sound when the cradle is rocked by a child. This rocking moves a freely suspended member of the musical instrument and causes contact between the freely suspended member and a fixed member, so that a musical sound is emitted which is harmonious, pleasant and melodious to the ear, thus inducing the child to play with the toy by rocking the cradle. Thus, the pleasure of the child with the toy is enhanced.

The musical instrument, which is typically a plurality of chimes or musical tone bars in combination with a freely suspended pendulum striker, is mounted on a headboard of the toy rocking cradle, and is preferably disposed centrally on the inner surface of a headboard below the lower horizontal member of the cradle on which a doll is disposed. This preferable disposition of the musical instrument has the advantage that the musical instrument and its appurtenances such as an outer foraminous enclosure are hidden from the view of the child, thus inhibiting a curious child from causing damage to the toy. In addition, this preferable disposition of the musical instrument dilutes and diffuses the origin of the harmonious sound, so as to impart an impression comparable to a stereo effect.

The toy rocking cradle is generally characterized by the provision of two opposed spaced apart vertically oriented headboards, two opposed spaced apart vertically oriented side members extending between the headboards, and a horizontal bottom member supported by the side members and spaced above the bottom of the headboards. The headboards have curved lower edges, so that lateral force periodically applied to one or both of the side members will cause a rocking motion of the toy cradle when the cradle is placed on a fixed horizontal surface such as the floor of a child's playroom. The cradle is thus disposed with the curved lower edges of the headboards in contact with the horizontal surface. A doll is preferably integrally mounted in the toy cradle, preferably by being attached to the upper surface of the bottom member. The doll preferably is provided with integral means for emitting sound, typically comparable to a baby crying, when the position of the doll is changed.

The musical instrument generally is provided with at least one freely suspended movable member and at least one fixed member, so that contact between the movable member and the fixed member, when the cradle is rocked, causes the emission of a musical sound.

An important aspect of the invention is that the musical instrument is mounted on the surface of one of the headboards in such a manner that the movable member of the musical instrument is freely suspended, so that rocking motion of the toy cradle when imparted by a child causes the movable member to move, e.g., to partially rotate about an upper horizontal axis of suspension, and thus causes contact between the movable member and the fixed member to thereby cause the musical instrument to emit a musical sound, which is typically harmonious, i.e., pleasant and melodious to the ear. The musical sound may be comparable to the pleasant tinkle produced by a music box, however, the present configuration in the preferred embodiment of the musical instrument, namely a chimes, is much simpler and less costly than a music box, and also does not require periodic winding of a spring or the like, as is the case with a music box or the like.

BRIEF DESCRIPTION OF THE DRAWINGS

Referring now to the drawings,

FIG. 3 is a sectional elevation view of FIG. 2, taken on section 3—3; and

FIG. 4 is a sectional plan view of FIG. 3, taken on section 4—4.

DETAILED DESCRIPTION OF THE PREFERRED EMBODIMENTS

Figure 1:
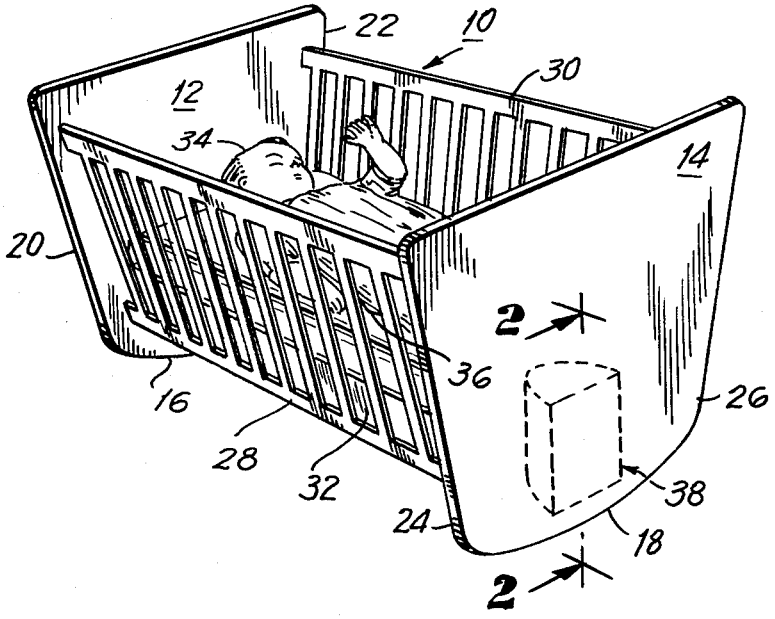
FIG. 1 is a perspective view of the overall combination of the invention.

Referring now to FIG. 1, an integral toy rocking cradle combination 10 is shown. The combination 10 includes a toy rocking cradle having two opposed spaced apart substantially vertically oriented headboards 12 and 14. The headboard 12 has a curved lower edge 16 and the headboard 14 has a curved lower edge 18. The lower edges 16 and 18 are in contact with a fixed substantially horizontal surface such as the floor of a child's playroom, when the toy is in use by a child. The headboard 12 is provided with generally vertically oriented side edges 20 and 22 which preferably taper inwards in a downwards direction. The headboard 14 is provided with side edges 24 and 26 which are similar in configuration to edges 20 and 22.

The assemblage is also provided with two opposed spaced apart substantially vertically oriented and generally rectangular side members 28 and 30 which extend between the headboards 12 and 14. The side member 28 connects with headboard 12 in close proximity to side edge 20, and member 28 connects with headboard 14 in close proximity to side edge 24. The side member 30 connects with headboard 12 in close proximity to side edge 22, and member 30 connects with headboard 14 in close proximity to side edge 26.

A substantially horizontal bottom member 32 is also provided to complete the toy rocking cradle per se. The member 32 is supported by the side members 28 and 30 and/or by the headboards 12 and 14. In most instances, the side members 28 and 30 will provide the principal or sole support for the member 32. The bottom member 32 is spaced from edges 16 and 18 and generally above the bottom of the headboards 12 and 14, by disposing the lower terminus of each of the side members 28 and 30 above the lower edges 16 and 18, so that a rocking motion of the toy cradle may be accomplished when lateral force is periodically applied by a child to at least one of the side members 28 and 30.

A doll 34 is mounted in a reclining position on the upper surface of the bottom member 32. The doll 34 is preferably furnished with an integral means or device 36 for emitting a sound, typically the crying of a baby, when the doll is moved.

The phantom outline of the generally vertically oriented and semi-elliptical enclosure 38 for the musical instrument is shown, in conjunction with headboard 14. The musical instrument and enclosure 38 are preferably mounted on the inner surface of the headboard 14 below the bottom member 32.

Figure 2:
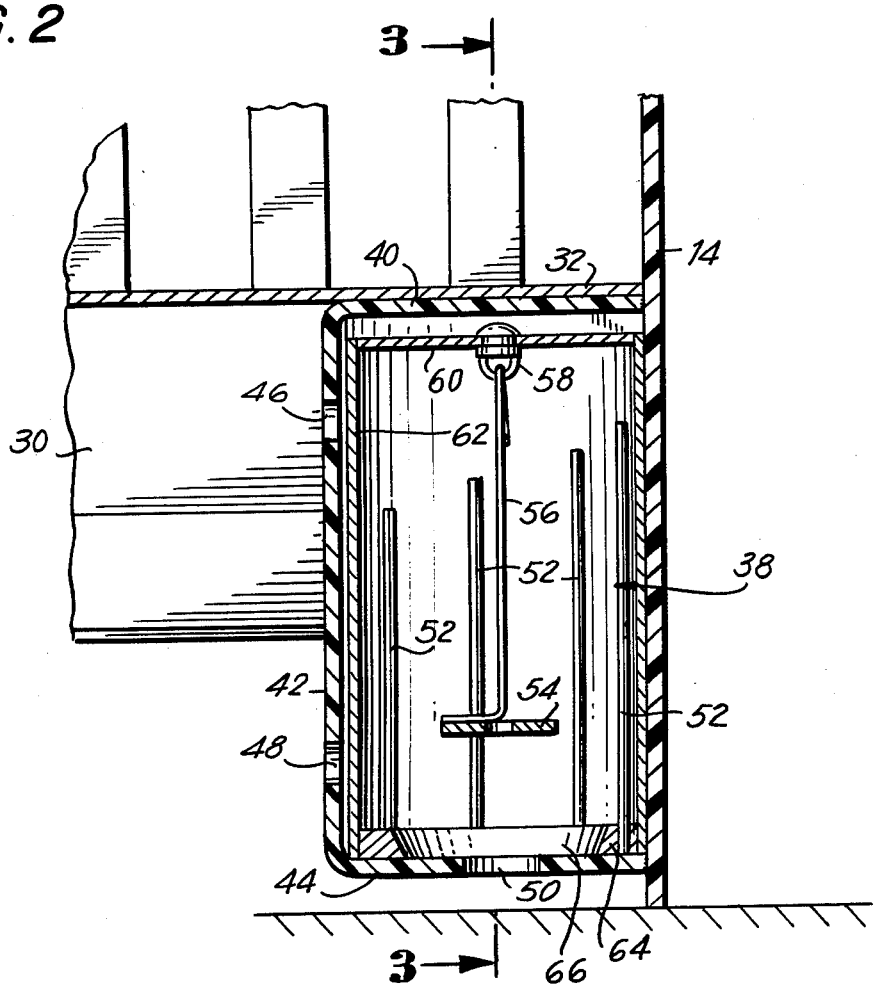
FIG. 2 is a sectional elevation view of a portion of FIG. 1, taken on section 2—2 and showing details of the preferred musical instrument embodiment of the present invention.

Referring now to FIG. 2, the enclosure 38 extends inwards from attachment to the inner surface of the headboard 14 below bottom member 32. Enclosure 38 is generally characterized in this preferred embodiment by the provision of an upper horizontal wall 40, a curved vertical wall 42 and a lower horizontal wall 44. As will appear infra, enclosure 38 is generally semi-elliptical or semi-oval in horizontal section, to accommodate a generally vertically oriented cylindrical musical instrument. Enclosure 38 is foraminous to permit emission of a musical sound from the internal musical instrument. Thus, wall 42 is provided with circular openings 46 and 48 and wall 44 is provided with circular opening 50.

In this embodiment of the invention, the musical instrument is a chimes or set of musical tone bars characterized by the provision of a plurality of vertically oriented bars or chimes 52, each element 52 having a vertical length or dimension different from the other elements 52, so that each chime 52 has a pitch different from the remainder of the chimes, with the elements 52 being arranged in succession so that when the chimes are rung or struck by the freely suspended pendulum striker 54, the chimes 52 will be struck in succession by striker 54 to produce a harmonious sound which is pleasant and melodious to the ear.

Striker 54 is freely suspended by the vertically oriented suspension rod 56 from an upper suspension mounting 58, which mounting 58 allows elements 56 and 54 to hang freely and to partially rotate about any horizontal axis through mounting 58, in the manner of a pendulum. The musical instrument is completed by the provision of an upper circular or disc-shaped wall 60 in which mounting 58 is centrally fastened, a vertically oriented cylindrical wall 62 which depends from the periphery of wall 60, and a lower circular chimes mount 64 which has a large central opening 66.

The opening 66 cooperates with opening 50 to permit the emission of pleasant musical sounds from the enclosure 38, when the toy cradle is rocked and motion of pendulum striker 54 is thereby initiated to ring the chimes 52.

FIG. 3 shows the musical instrument assemblage in full outline as when at rest and not emitting any musical sound, or when the rocking cycle is at midpoint. FIG. 3 also shows the musical instrument assemblage in phantom outline during rocking motion of the toy, when the striker 54 has moved to the right and is in contact with the chimes 52 and a musical sound is being emitted.

Referring now to FIG. 4, the circular nature of the musical instrument in plan view is shown, together with the semi-elliptical or semi-oval nature of the enclosure 38 in which the musical instrument is disposed.

Numerous alternatives within the scope of the present invention, besides those alternatives mentioned supra, will occur to those skilled in the art. Various other types of musical instruments, such as a bell or the like, may be provided for the combination of the present invention.

The musical instrument may conveniently be mounted on any headboard surface of the toy rocking cradle, or even in an opening in the headboard, however, the musical instrument is preferably centrally mounted on an inner headboard surface below the bottom member 32 for the reasons discussed supra.

Having thus described the invention, there is claimed as new and desired to be secured by Letters Patent:

1. The combination of a toy rocking cradle with integral musical instrument comprising a toy cradle, said cradle having two opposed spaced apart substantially vertically oriented headboards, two opposed spaced apart substantially vertically oriented side members extending between said headboards, and a substantially horizontal bottom member supported by said side members, said bottom member being spaced above the bottom of said headboards, said headboards having curved lower edges, whereby lateral force periodically applied to at least one of said side members will cause a rocking motion of said toy cradle when said cradle is disposed on a fixed substantially horizontal surface with said curved lower edges of said headboards in contact with said surface, and a musical instrument mounted on the inner surface of said headboard entirely below said bottom member, said musical instrument being generally cylindrical with the central vertical axis of said musical instrument being juxtaposed with the central vertical axis of said headboard, said musical instrument being disposed in a semi-elliptical foraminous enclosure, said enclosure having lateral and lower openings and being attached to said headboard entirely below said bottom member, said musical instrument consisting of a freely suspended pendulum striker and a plurality of spaced apart fixed vertical chimes arranged in a circle, said striker being suspended from a mounting disposed above the center of said circle, each chime of said plurality of chimes having an individual length and pitch different from the remainder of the chimes, whereby said chimes produce a harmonious sound which is pleasant and melodious when struck in succession by said striker, when a rocking motion is imparted to said cradle.

2. The combination of claim 1, in which a doll is mounted on said bottom member, said doll being provided with integral means for emitting sound when the position of said doll is changed.

* * * * *